US006681955B2

(12) United States Patent
Rosenbaum

(10) Patent No.: US 6,681,955 B2
(45) Date of Patent: Jan. 27, 2004

(54) DEVICE FOR STORING AND A CONTROLLED DELIVERY OF A PRESSURIZED PRODUCT

(75) Inventor: Ulrich Rosenbaum, Wangs (CH)

(73) Assignee: Hilti Aktiengesellschaft, Schaan (LI)

( * ) Notice: Subject to any disclaimer, the term of this patent is extended or adjusted under 35 U.S.C. 154(b) by 37 days.

(21) Appl. No.: 10/158,514

(22) Filed: May 30, 2002

(65) Prior Publication Data

US 2002/0179636 A1 Dec. 5, 2002

(30) Foreign Application Priority Data

May 31, 2001 (DE) ..... 101 26 489

(51) Int. Cl.[7] ..... B65D 35/08
(52) U.S. Cl. ..... 222/107; 222/95; 222/402.24
(58) Field of Search ..... 222/92, 95, 105, 222/107, 386.5, 402.1, 402.2, 402.24

(56) References Cited

U.S. PATENT DOCUMENTS 2,900,114 A * 8/1959 Utz ..... 222/402.24
4,762,254 A * 8/1988 Nitta ..... 222/402.24
4,969,577 A * 11/1990 Werding ..... 222/94
5,007,556 A * 4/1991 Lover ..... 222/386.5
5,167,347 A * 12/1992 Wiegner et al. ..... 222/94
5,326,002 A * 7/1994 Dubini ..... 222/402.1
5,630,530 A * 5/1997 Geier et al. ..... 222/402.1
RE35,540 E * 6/1997 Davies et al. ..... 222/386.5
5,730,326 A * 3/1998 Kaeser ..... 222/95
2003/0071078 A1 * 4/2003 Park ..... 222/402.24

* cited by examiner

*Primary Examiner*—Kenneth Bomberg
(74) *Attorney, Agent, or Firm*—Sidley Austin Brown & Wood, LLP

(57) ABSTRACT

A device for storing and control delivery of a pressurized product in which the valve (3) that connects the outer and inner containers, has a housing connecting the outer and inner containers (1), a piston (11), and a sealing region which is formed a stop surface (19) provided on the outer container (1) and facing in a direction opposite to a delivery direction of the pressurized product (16), a sealing surface (12) provided on the valve piston (11) and facing in the delivery direction, and a valve sealing ring (14) located between the stop surface (19) of the outer container and the sealing surface (12) of the valve piston (11), with the valve sealing region being arranged in an interior of the inner container (2).

8 Claims, 2 Drawing Sheets

5
4
13
7a
7'
1
3
7
15
23
18
20
19
14
12
6
11
2
7''
2a
2b
2
9
8a
8
16

5
4
13
7a
1
3
7
15
23
19
21
12
14
6
11
22
2
2a
2b
2c
9
8a
8
2
16

DEVICE FOR STORING AND A CONTROLLED DELIVERY OF A PRESSURIZED PRODUCT

BACKGROUND OF THE INVENTION

1. Field of the Invention

The present invention relates to a device for storing and a controlled delivery of a pressurized product and including a substantially dimensionally stable outer container, a flexible inner container for storing the pressurized product and located in the outer container, a pressurized liquid or gaseous motive medium located in an intermediate space between the outer container and the inner container, and a valve for connecting the outer and inner containers and having a housing for connecting the outer and inner containers, a piston, and a sealing region.

2. Description of the Prior Art

European publication EP 0 320 510B1 discloses a device for storing and a controlled delivery of a pressurized product and including a substantially dimensionally stable outer container, a flexible inner container for storing the pressurized product and located in the outer container, a pressurized liquid or gaseous motive medium located in an intermediate space between the outer container and the inner container, and a valve for connecting the outer and inner containers.

Because the valve can be welded to the inner container, the inner layer of the inner container and the valve housing are formed of an easy weldable material. As a rule, polyethylene (PE) or polypropylene (PP) are used. However, these materials are not sufficiently diffusion-proof. Therefore, the motive means, gas or liquid, can intermix with the product stored in the inner container as a result of a diffusion process. This causes a pressure drop in the motive medium and contamination of the stored product.

Accordingly, an object of the present invention is to provide a device for storing and a controlled delivery of a pressurized product in which intermixing of the product, which is stored in the inner container, with the motive gas or liquid, which is located in the intermediate space between the outer and inner containers, is reliably prevented.

SUMMARY OF THE INVENTION

This and other objects of the present invention, which will become apparent hereinafter, are achieved by providing a device for storing and a controlled delivery of a pressurized product in which the inner container is formed of a foil of a diffusion-proof material, and the valve sealing region is arranged in the interior of the inner container.

The arrangement of the valve sealing region in the inner container and forming the inner container of a diffusion-proof material prevent intermixing of the pressurized product with the motive gas or liquid. The motive medium, which diffuses through the valve housing, is expelled from the device through the opening in the outer container.

In order to prevent the product from leaving the inner container when the valve is in its non-actuated position, preferably the valve piston is biased against a stop surface provided on the valve housing by a spring, with the valve sealing ring being arranged between the valve piston and the stop surface.

According to the present invention, a valve spool, which is formed integrally with the valve piston, projects from the piston in the product delivery direction and has a side opening located in the region of the valve sealing ring and opening into a central outlet channel formed in the spool. The outlet opening of the outlet channel of the valve spool is located in the end surface of the spool remote from the valve sealing region. In the valve closed position, the side inlet opening is located outside of the valve sealing region, i.e., outside of the inner container. For moving the valve to its open position, the piston is displaced in a direction opposite the delivery direction against the biasing force of the spring that biases the piston against the stop surface provided on the valve housing. Upon movement of the piston in the direction opposite the delivery direction, the side inlet opening of the spool is located in the interior of the inner container, and the product flows through the side inlet opening and the central outlet channel outside of the device.

Preferably, to provide for a good weldability of the valve housing with the inner container, the foil, of which the inner container is made, is formed of two layers. In addition to the layer of a substantially diffusion-proof material, there is provided a further, inner layer formed of the material weldable with the valve housing.

Advantageously, the foil has, in addition to a layer of a substantially diffusion-proof material, a further, outer layer formed of a material resistant to a mechanical load.

The diffusion-proof material is usually aluminum or an aluminum alloy.

A particularly good weldability of the valve housing with the inner container is achieved when both the inner layer of the inner container and the valve housing are formed of polyethylene (PE) or polypropylene (PP).

The outer layer of the inner container is usually formed of polyamide or polyester.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
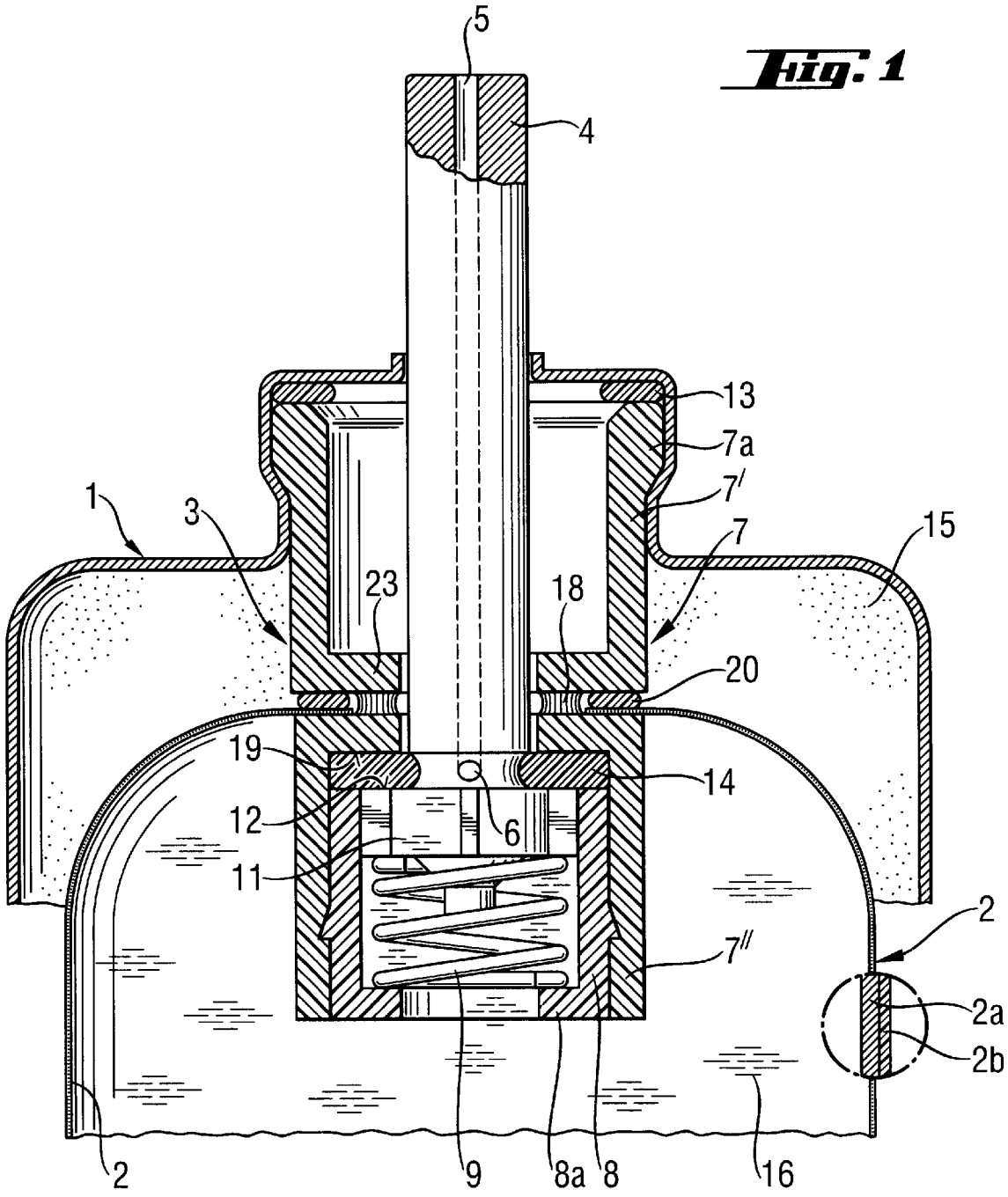
FIG. 1 shows a cross-sectional view of a first embodiment of a device for storing and delivery of a pressurized product according to the present invention.
Figure 2:
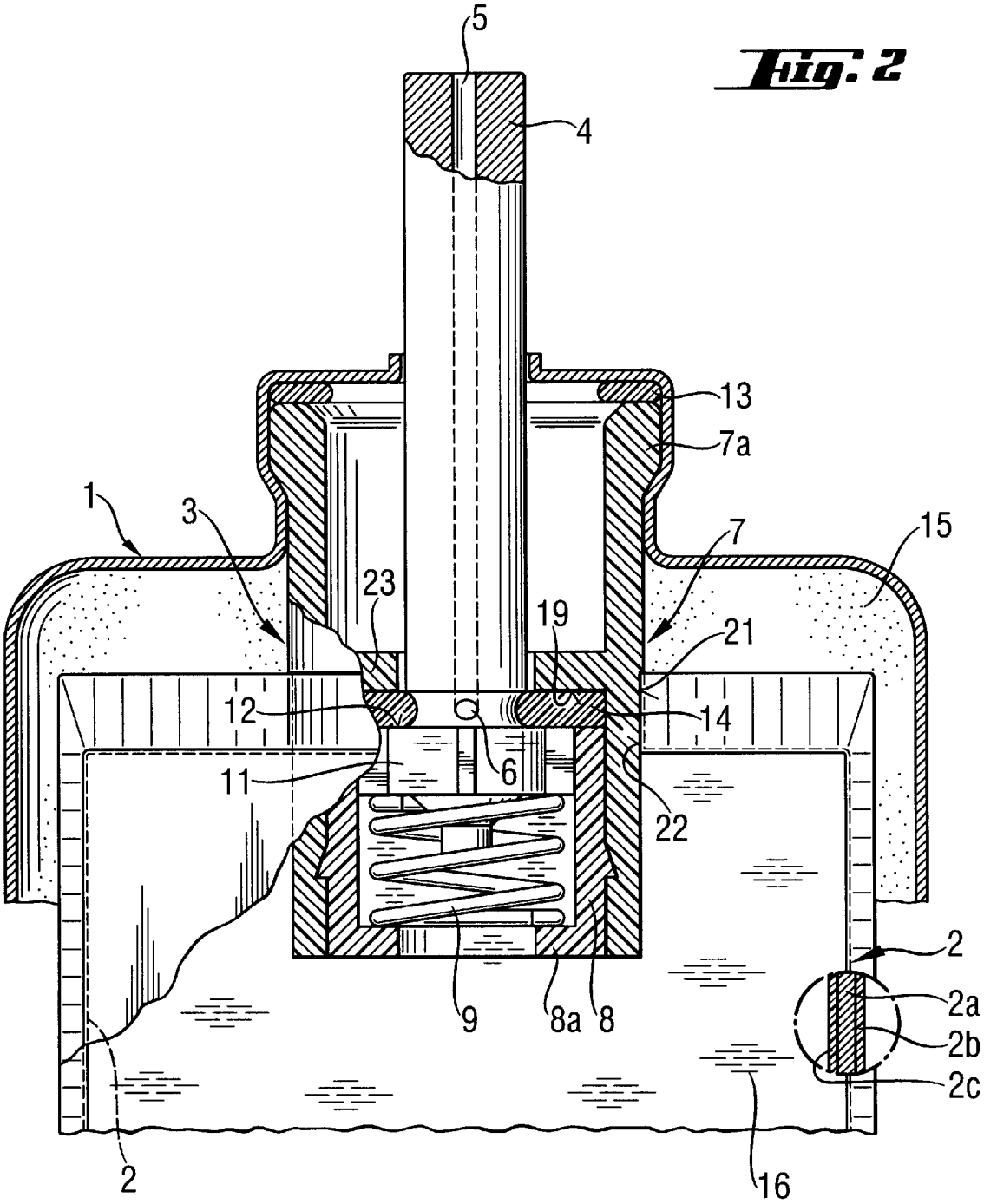
FIG. 2 shows a cross-sectional view of a second embodiment of a device for storing and delivery of a pressurized product according the present invention.

A device for storing and delivery of a pressurized product 16 according to the present invention, which is shown in FIGS. 1–2, can be formed, e.g., as an aerosol can. In both FIGS. 1 and 2, the same reference numerals are used for the designation of the same elements. The inventive device includes a dimensionally stable outer container 1 and a flexible inner container 2 arranged in the outer container 1. The two containers 1 and 2 are connected with each other by a valve 3. The pressurized product, 16, e.g., a pressurized ignitable gas, is received in the inner container 2.

The valve 3 has a substantially tubular valve housing 7 having a stop surface 19. In the valve housing 7, there are arranged a piston 11, a cylindrical valve spool 4, which is formed integrally with the piston 11, a spring 9, a sealing ring 14, and a locking sleeve 8. The stop surface 19 is formed by an intermediate wall 23 of the valve housing 7 located in the middle region of the housing 7. The valve spool 4 projects from the piston 11 in the delivery direction and extends through the intermediate wall 23 and through an opening formed in the outer container. In the region of the sealing ring 14, the valve spool 4 has an inlet opening 6 that opens into a central outlet channel 5 of the valve spool 4.

The sealing region of the valve 3 is formed by the stop surface 19 of the housing 7, by a sealing surface 12 of the piston 11 facing in the delivery direction of the product 16, and by a sealing ring 14 located between the stop surface 19 of the housing 7 and the sealing surface 12 of the piston 11.

The valve 3 is substantially located in the inner container 2. In a closed position of the device, the spring 9 biases the piston in the delivery direction, and the sealing region of the valve 3 seals the inner container 2 against atmosphere. When the piston 11 is displaced against the biasing force of the spring 9, in the direction opposite to the delivery direction, to its release position, the product 16 can flow out of the device.

In the intermediate space between the outer container 1 and the inner container 2, there is stored, under pressure, liquid and/or gaseous motive means 15. The inner container 2 is formed of a foil made of at least one, substantially diffusion-proof material.

The valve housing 7 has a free end region with a radially widened outer profile 7*a*. The radially widened outer profile serves to formlockingly axially secure the valve housing 7 in the outer container 1.

The intermediate space between the outer container 1 and the inner container 2 is sealed against the atmosphere by an elastic sealing ring 13. The sealing ring 13 is arranged between the first, free end of the valve housing 7 which faces in the delivery direction and adjoins the widened outer profile 7*a* of the valve housing 7, and a bearing surface of the outer container 1 which faces in the direction counter to the delivery direction.

The valve sealing ring 14, which forms part of the sealing region, is axially secured with the locking sleeve 8. The locking sleeve 8 extends from the second end of the valve housing 7 opposite the widened outer profile 7*a* into the valve housing 7. The locking sleeve 8 is formlockingly secured in the valve housing 7. The spring 9 is located between a stop shoulder 8*a* of the locking sleeve 8, which faces in the delivery direction, and the piston 11.

The inner container 2, which is shown in FIG. 1, is formed, as it has already been discussed above, of a foil having a layer 2*a* made of a substantially diffusion-proof material. The container 2 can be covered with a layer 2*b* of a further material resistant to mechanical loads.

The valve housing, which is shown in FIG. 1, is formed of two coaxial parts 7' and 7" between which the circumferential region of the opening of the inner container 2 and a sealing ring 20 are located. The region of the inner container 2, which surrounds its opening, is sealed with the sealing ring 20 that remains in a compression state by the provision of a weld 18 between the two parts 7' and 7" of the valve housing 7.

The foil, of which the inner container 2 shown in FIG. 2 is formed of three layers 2*a*, 2*b*, 2*c* (shown at a larger scale). In addition to the layer 2*a* formed of a substantially diffusion-proof material, there are provided further an inner layer 2*c* and an outer layer 2*b*. The inner layer 2*c* is formed of a material weldable with the valve housing 7, e.g., polyethylene (PE) or polypropylene (PP). The outer layer 2*b* is formed of a material resistant to mechanical loads, e.g., polyamide or polyester. As a diffusion-proof material, aluminum or an aluminum alloy is used.

The valve housing 7, which is shown in FIG. 2, is formed, e.g., of polyethylene (PE) or polypropylene (PP). The valve housing 7 is formed as a one-piece part. The opening region 22 of the inner container 2, which surrounds the outer surface 21 of the valve housing 7, is welded thereto.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiments or details thereof, and the present invention includes all of variations and/or alternative embodiments within the spirit and scope of the present invention as defined by the appended claims.

What is claimed is:

1. A device for storing and a controlled delivery of a pressurized product (16), comprising a substantially dimensionally stable outer container (1); a flexible inner container (2) for storing the pressurized product (16) and located in the outer container (1) and formed of a foil having at least one layer (2*a*) formed of a substantially diffusion-proof material; at least one of a pressurized liquid motive means and a pressurized gaseous motive means located in an intermediate space between the outer container (1) and the inner container (2); and a valve (3) for connecting the outer (1) and inner (2) containers, the valve (3) having a housing (7) for connecting the outer and inner containers (1), a piston (11), and a sealing region which is formed a stop surface (19) provided on the outer container (1) and facing in a direction opposite to a delivery direction of the pressurized product (16), a sealing surface (12) provided on the valve piston (11) and facing in the delivery direction, and a valve sealing ring (14) located between the stop surface (19) of the outer container and the sealing surface (12) of the valve piston (11), the valve sealing region being arranged in an interior of the inner container (2).

2. A device according to claim 1, further comprising a spring (9) for biasing the piston (11) in the delivery direction, the piston (11) displacing the valve sealing region in the direction opposite the delivery direction upon being displaced in the direction opposite the delivery direction.

3. A device according to claim 2, further comprising a valve spool (4) projecting from the piston (11) in the delivery direction and having a central outlet channel (5) and a side opening (6) located in a region of the valve sealing ring (14) and opening into the central outlet channel (5).

4. A device according to claim 1, wherein the foil has, in addition to the layer (2*a*) of a substantially diffusion-proof material, a further inner layer (2*c*) formed of a material weldable with the valve housing (7).

5. A device according to claim 4, wherein the inner layer (2*c*) and the valve housing are formed of one of polyethylene and polypropylene.

6. A device according to claim 1, wherein the foil has, in addition to the layer (2*a*) of a substantially diffusion-proof material, a further outer layer (2*b*) formed of a material resistant to mechanical loads.

7. A device according to claim 6, wherein the outer layer (2*b*) is formed of one of polyamide and polyester.

8. A device according to claim 1, wherein one of aluminum or an aluminum alloy is used as a diffusion-proof material.

* * * * *